US006409268B1

(12) United States Patent
Cvek

(10) Patent No.: US 6,409,268 B1
(45) Date of Patent: Jun. 25, 2002

(54) FLEXIBLE CHAIR BACK

(75) Inventor: Sava M. Cvek, Jamaica Plain, MA (US)

(73) Assignee: Stylex, Inc., Delanco, NJ (US)

( * ) Notice: Subject to any disclaimer, the term of this patent is extended or adjusted under 35 U.S.C. 154(b) by 0 days.

(21) Appl. No.: 09/590,938

(22) Filed: Jun. 9, 2000

(51) Int. Cl.[7] ..... A47C 7/40

(52) U.S. Cl. ..... 297/452.29; 297/452.32; 297/284.4; 297/452.15

(58) Field of Search ..... 297/452.1, 452.11, 297/452.12, 452.15, 452.18, 452.29, 452.32, 452.3, 284.8, 284.1, 284.3, 284.4, 283.1, 283.3

(56) References Cited

U.S. PATENT DOCUMENTS

| | | | | |
|---|---|---|---|---|
| 4,418,958 A | | 12/1983 | Watkin | |
| 4,502,731 A | | 3/1985 | Snider | |
| 4,647,109 A | | 3/1987 | Christophersen et al. | |
| 4,660,887 A | | 4/1987 | Fleming et al. | |
| D299,192 S | | 1/1989 | Chadwick et al. | |
| 4,856,845 A | | 8/1989 | Massonnet | |
| 4,856,846 A | | 8/1989 | Lohmeyer | |
| 4,962,964 A | | 10/1990 | Snodgrass | |
| 5,015,038 A | | 5/1991 | Mrotz, III | |
| 5,018,791 A | | 5/1991 | Zapf | |
| 5,154,485 A | | 10/1992 | Fleishman | |
| 5,340,197 A | * | 8/1994 | Vogtherr | 297/452.12 |
| 5,407,247 A | | 4/1995 | Forcier et al. | |
| 5,518,294 A | * | 5/1996 | Ligon | 297/284.4 |
| 5,997,094 A | | 12/1999 | Cvek | |

* cited by examiner

*Primary Examiner*—Beth A. Stephan
(74) *Attorney, Agent, or Firm*—Stuart E. Beck

(57) ABSTRACT

A flexible chair back comprising a back supporting surface that is defined by a plurality of generally downwardly directed curvilinear shaped openings arranged in a vertical array. Each of the curvilinear openings is around the next adjacent lower curvilinear opening so that they define a plurality of upwardly directed back supporting members. The back supporting members bend to follow the curvature of the back.

19 Claims, 3 Drawing Sheets

FLEXIBLE CHAIR BACK

FIELD OF THE INVENTION

This invention relates to a chair back, and in particular to a one piece chair back which bends to a curvature that approximates the curvature of the back when it bends to provide lumbar and upper back support.

BACKGROUND OF THE INVENTION

It is well known that when a person leans back, as for example when sitting, the spine curves to accommodate the bending. Further, it is known that the spine does not bend in a smooth arc starting at the waist. Rather, the amount of curvature varies along its length. Thus, in the lumbar region the radius of bending is relatively small. As one moves up the spine the radius of bending increases until at the upper part of the spine there is virtually no bending.

Therefore, it would be desirable to have a chair back that would offer a high degree of support to the lumbar and upper back which bends to approximate the curvature of the back.

Further, it would be especially advantageous if such a chair were capable of being connected to a wide variety of chair bases and seats.

In addition, it would be advantageous if the chair back could support the spine when the person is twisting in the chair such as when leaning to the left or right such as when reaching across a desk.

SUMMARY OF THE INVENTION

Accordingly, with the foregoing in mind, the invention relates to an ergonomic chair back which includes an upwardly extending tab in the lumbar supporting part of the chair back and a plurality of downwardly directed generally curvilinear tabs that are disposed adjacent each other in an upwardly extending array from the lumbar supporting part of the chair back.

DESCRIPTION OF A PRESENTLY PREFERRED FORM OF THE INVENTION

Figure 1:
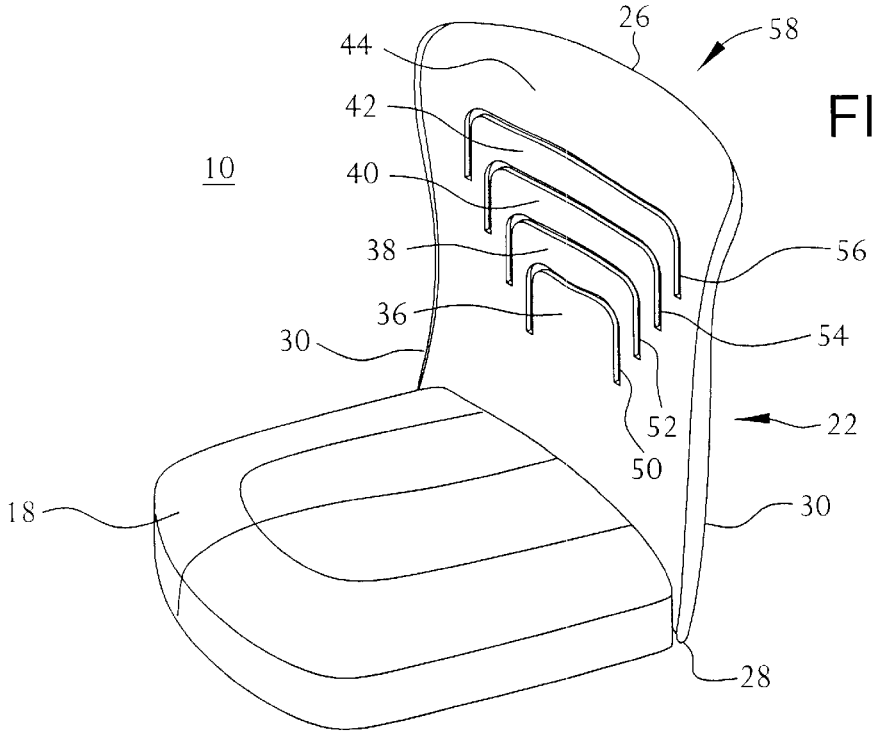
FIG. 1 is a three-quarter front view of a chair with a chair back constructed in accordance with a present preferred form of the invention is connected.
Figure 2:
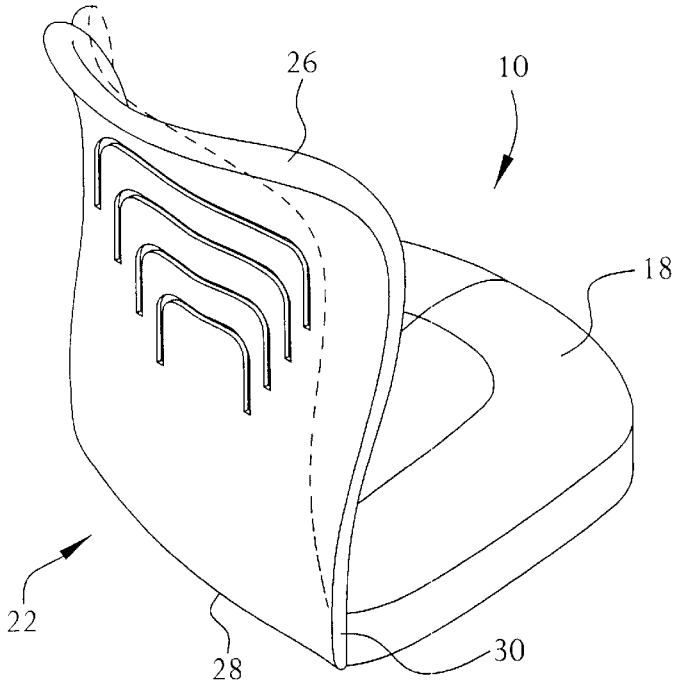
FIG. 2 is a three quarter rear view of the chair shown in FIG. 1.

FIGS. 1 and 2 show a chair 10 having a pedestal (not shown), a seat 18 and a chair back 22 which is constructed in accordance with a presently preferred form of the invention.

The chair back 22 may be connected to the chair 10 by a J-bar or other well known mechanism that is connected to the seat or pedestal and provides for tilting and height adjustment of the chair back in a well known manner.

The chair back 22 is generally rectangular with top and bottom edges 26 and 28 and sides 30. The sides 30 may be generally V-shaped so that the chair back width is reduced in the lumbar supporting area.

The chair back 22 may be comprised of unitary piece of molded thermoplastic such as glass reinforced nylon.

The chair back 22 is provided with a plurality of curvilinear tabs 36, 38, 40, 42 and 44 that are defined by downwardly directed curvilinear slots 50, 52, 54 and 56 that permit the chair back 22 to flex around both horizontal and vertical axes, as will be described in more detail.

As best seen in FIGS. 1 and 2, the chair back 22 is generally concave to comfortably receive the body of a person sitting in it. The back of the lower portion comprises a housing 32 which contains means (not shown) for connecting the chair back 22 to the rest of the chair.

Figure 4:
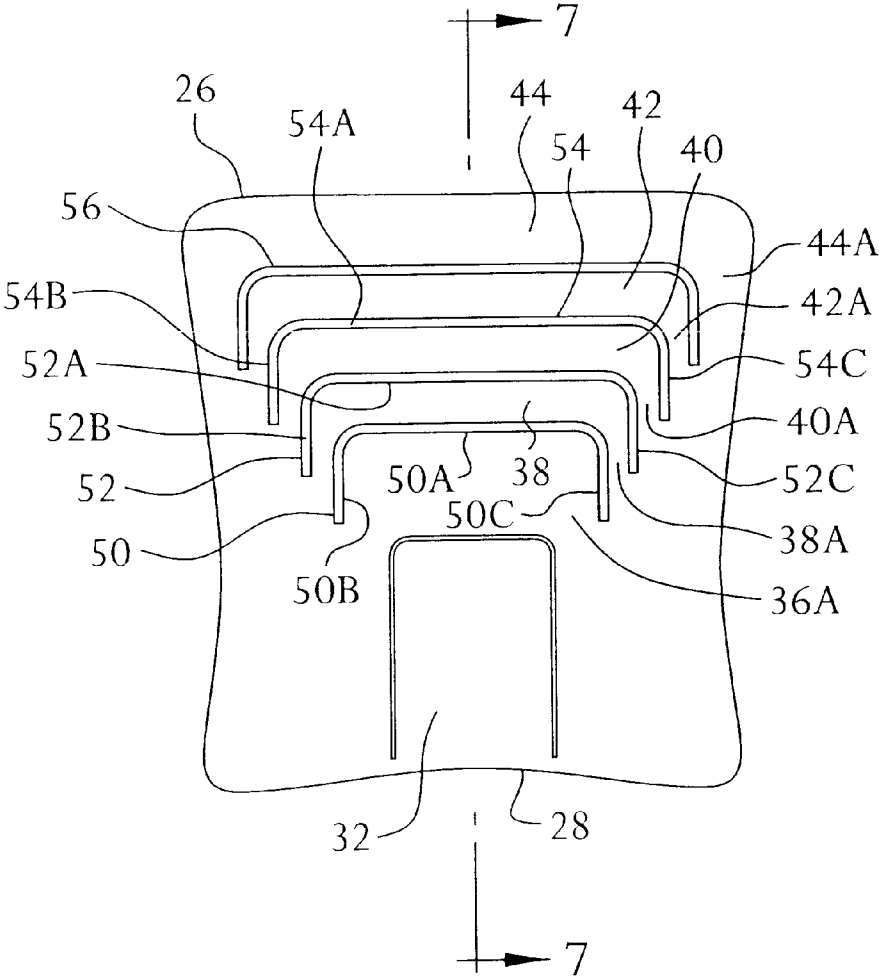
FIG. 4 is a front view of the chair back shown in FIGS. 1 and 2,.

As best seen in FIGS. 1 and 4, the chair back 22 includes a plurality of generally downwardly directed curvilinear slots such as U-shaped slots 58 which define the upwardly extending tabs, one of which, 36, is in the lumbar supporting area of the chair back 22. The remainder of the tabs are disposed above tab 36 in an array that extends the full length of the chair back.

The legs of the tabs 36A, 38A, 40A 42A and 44A overlap the next lower adjacent legs 38A, 40A and 42A as will be more fully explained to enable the chair back 22 to bend around both horizontal and vertical axes to support the back during bending and twisting.

The tab 36 in the lumbar area of the chair back 22 is upwardly directed and is defined by a curvilinear slot such as generally U-shaped slot 50 having horizontal and vertical portions 50A, 50B and 50C.

The upper end of tab 36 resiliently flexes around a hinge area defined by its connection to the chair back 22.

Above and surrounding slot 50 is another curvilinear slot such as generally U-shaped slot 52 having horizontal and vertical portions 52A, 52B and 52C. The space between the slots defines the second tab 38 that includes horizontal and vertical portions 38A and 38B.

In a manner similar to that just described, above and surrounding slot 52 is another curvilinear slot such as generally U-shaped slot 54 having horizontal and vertical portions 54A, 54B and 54C. The space between the slots defines a third tab 40 that include s horizontal and vertical portions 40A, 40B and 40C.

The vertical portions of tab 40 serve as hinges to permit the tab 40 to resiliently flex under a load to support the portion of the back above the area supported by tab 38.

In like manner tabs 42 and 44 are defined by slots 54, 56 and the top edge 26. The vertical portions of the tabs 42 and 44 serve as hinges to permit the tabs 42 and 44 to resiliently flex under a to support the upper part of the back.

As best seen in FIGS. 1 and 4, the vertically extending portions of each slots 52, 54 and 56 overlap the vertically extending portions of the next adjacent slot. However, the legs of the upper slots are progressively longer than the vertically extending portions of the lower slots.

Also, the distance between the slots progressively varies so that the width of the tabs varies with the upper tab 44 being the widest and tab 38 being the narrowest.

Figure 5:
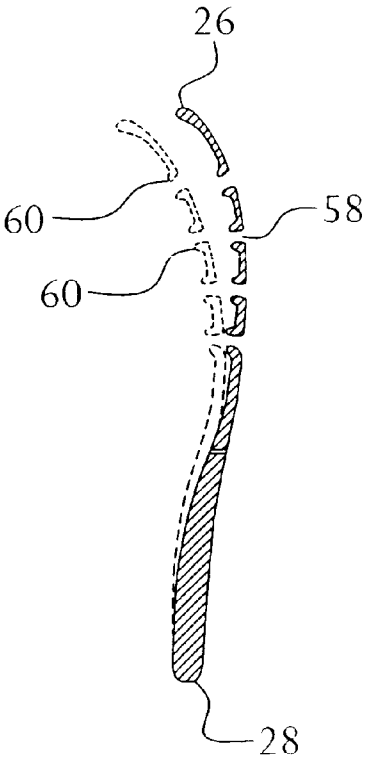
FIG. 5 is a section view taken along line 5—5 of FIG. 4.

As best seen in FIG. 5 the perimeter of each tab 36, 38, 40 42 and 44 supports a rearwardly directed ridge 60 which tends to stiffen and increase the support that the tabs give to the back.

The combination of the progressively increasing width of the tabs above the lumbar tab and the progressively shortening of the vertically extending portions comprising the slots 50, 52, 54, 56 cooperate to enable the chair back 22 to flex rearwardly as shown in FIG. 5 where the radius of curvature increases from the lumbar area to the upper edge of the chair.

Figure 3:
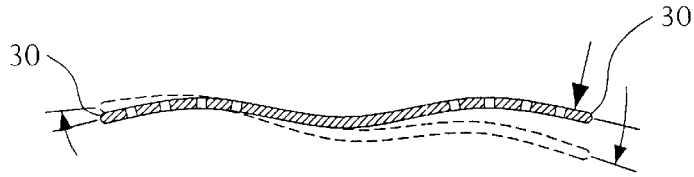
FIG. 3 is a top view of the back of the chair shown in FIGS. 1 and 2.

The reduced width of the sides of the chair back in the lumbar area cooperate with the downwardly extending portions of the slots to enable the chair back 22 to twist more easily around a vertical axis as when a person leans to one side of the chair as seen in FIGS. 2 and 3.

Figure 7:
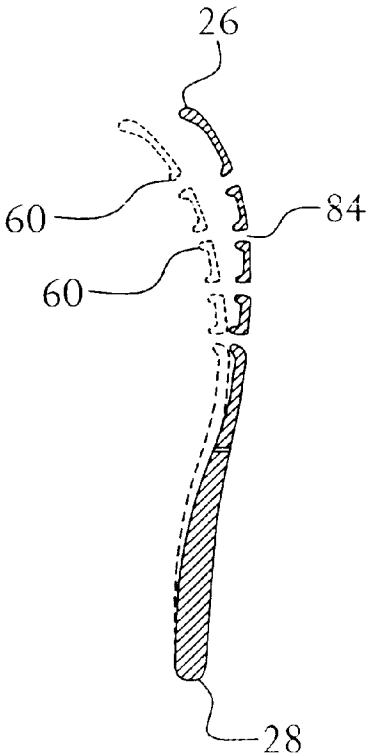
FIG. 7 is a section view taken along line 7—7 of FIG. 6.
Figure 6:
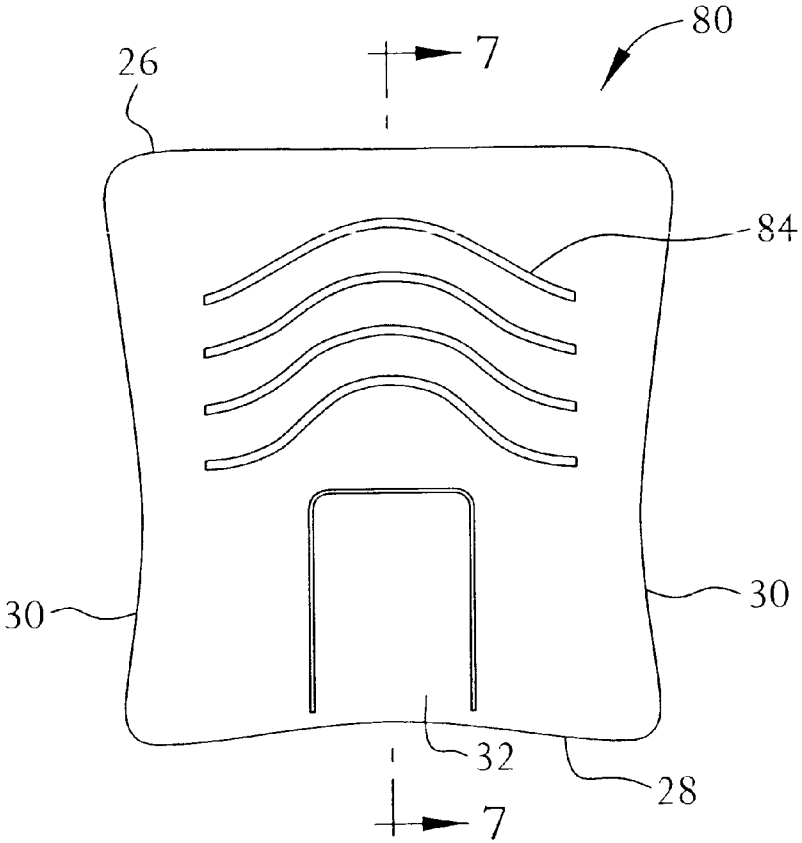
FIG. 6 is a front view of another form of a chair back constructed in accordance with the invention.

Referring to FIGS. 6 and 7 a chair back showing another form of the curvilinear tabs 80 is shown. In this form of the invention the tabs are generally bow shaped and are defined by bow shaped'slots 84 between them. However, it should be understood the that the objectives of the invention can be achieved with tab. of any curvilinear shape if their downwardly extending legs of each tab overlies the downwardly extending legs of the tabs below it.

If desired, padding can be connected to the front surface of the chair of the chair back to improve the comfort and appearance of the back. Preferably, the padding is removably secures to the chair back so that it can be removed as desired.

What has been described is a chair back which can be attached to a standard fitting so that it is useful with different types of chairs.

Further, the chair accommodates and supports the back by flexing to a curvature which corresponds to the curve of the back. Further, the. chair also supports a person who is leaning or twisting to the side.

While the invention has been described with regard to a particular forms, it is apparent that other forms will be obvious to those skilled in the art in view of the foregoing description. Thus, the invention should not be limited by the foregoing description, but rather only by the scope of the appended claims.

I claim:

1. A flexible chair back, said chair back comprising a back supporting surface, a plurality of generally downwardly directed curvilinear shaped openings formed in said back supporting surface in a vertical array, each of said curvilinear openings being around the next adjacent lower curvilinear opening, said curvilinear shaped openings being U-shaped and defining a plurality of upwardly directed back supporting members, and said back supporting members flex around horizontal axes to follow the curvature of the back.

2. A chair back as defined in claim 1 wherein said chair back includes an upper portion, and said generally U-shaped openings are in the upper portion of said chair back.

3. A chair back as defined in claim 1 wherein said upwardly directed back supporting members include ridges to increase their stiffness and increase the support that they provide.

4. A chair back as defined in claim 3 wherein said back supporting members are bow shaped.

5. A chair back as defined in claim 1 wherein said back supporting members are curvilinear.

6. A chair back as defined in claim 1 wherein said chair back is comprised of a thermoplastic.

7. A chair back as defined in claim 1 including means connected to the lower portion of said chair back for connecting it to a chair.

8. A chair back as defined in claim 1 wherein said chair back is generally S shaped.

9. A chair back as defined in claim 2 wherein the lower portion of said chair back is concave.

10. A chair as defined in claim 1 wherein the distance between adjacent ones of said openings progressively increases with the distance of said opening from the lower portion of said chair back.

11. A chair as defined in claim 1 wherein said chair back bends under a load to substantially the same curvature as the spine.

12. A flexible chair back, said chair back comprising a back supporting surface, a plurality of generally downwardly directed bow-shaped openings formed in said back supporting surface, said bow-shaped openings being arranged in a vertical array, each of said bow-shaped openings being around the next adjacent lower bow-shaped opening, said bow-shaped openings defining a plurality of upwardly directed back supporting members, and said back supporting members are operative to flex around horizontal axes to follow the curvature of the back.

13. A chair back as defined in claim 12 wherein said chair back includes an upper portion, and said generally bow-shaped openings are in the upper portion of said chair back.

14. A chair back as defined in claim 12 wherein said upwardly directed back supporting members include ridges to increase their stiffness and increase the support that they provide.

15. A chair back as defined in claim 12 wherein said chair back is comprised of a thermoplastic.

16. A chair back as defined in claim 12 including means connected to the lower portion of said chair back for connecting it to a chair.

17. A chair back as defined in claim 12 wherein said chair back is generally S shaped when viewed from the side, and the lower portion of said chair back is concave.

18. A chair as defined in claim 12 wherein the distance between adjacent ones of said openings progressively increases with the distance of said opening from the lower portion of said chair back so that the upper portion of said chair back offers more resistance to flexing than the lower portion of said back.

19. A chair as defined in claim 12 wherein said chair back is operative to bend under a load to substantially the same curvature as the spine.

* * * * *